US010589906B2

(12) United States Patent
Biery

(10) Patent No.: US 10,589,906 B2
(45) **Date of Patent: *Mar. 17, 2020**

(54) TRAY WITH RE-CLOSEABLE LID

(71) Applicant: Biery Cheese Co., Louisville, OH (US)

(72) Inventor: Benjamin H. Biery, Louisville, OH (US)

(73) Assignee: Biery Cheese Co., Louisville, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/416,360

(22) Filed: May 20, 2019

(65) Prior Publication Data

US 2019/0270566 A1 Sep. 5, 2019

Related U.S. Application Data

(62) Division of application No. 14/836,171, filed on Aug. 26, 2015, now Pat. No. 10,329,064.

(51) Int. Cl.

| | |
|---|---|
| ***B65D 73/00*** | (2006.01) |
| ***B65D 43/16*** | (2006.01) |
| ***B65D 75/36*** | (2006.01) |
| *B65D 75/56* | (2006.01) |
| *B65D 85/76* | (2006.01) |

(52) U.S. Cl.

CPC ..... *B65D 43/162* (2013.01); *B65D 75/36* (2013.01); *B65D 75/366* (2013.01); *B65D 75/566* (2013.01); *B65D 85/76* (2013.01); *B65D 2575/368* (2013.01)

(58) Field of Classification Search

CPC .... B65D 43/162; B65D 75/36; B65D 75/366; B65D 75/566; B65D 85/76; B65D 2575/368

USPC ..... 206/467, 469–471, 564; 220/810, 837

See application file for complete search history.

(56) References Cited

U.S. PATENT DOCUMENTS

| | | | |
|---|---|---|---|
| 3,463,309 | A | 8/1969 | Szostek |
| 3,583,623 | A | 6/1971 | Golner |
| 4,236,636 | A | 12/1980 | Kuchenbecker |
| 4,498,589 | A | 2/1985 | Scott et al. |
| 4,501,363 | A | 2/1985 | Isbey, Jr. |
| 4,574,951 | A | 3/1986 | Weaver |
| D288,481 | S | 2/1987 | Holewinski et al. |
| D288,606 | S | 3/1987 | Blatherwick et al. |
| 4,681,223 | A | 7/1987 | Roberts |
| 4,750,669 | A | 6/1988 | Leight |
| 5,209,354 | A | 5/1993 | Thornhill et al. |

(Continued)

*Primary Examiner* — Luan K Bui

(74) *Attorney, Agent, or Firm* — Sand, Sebolt & Wernow Co., LPA

(57) ABSTRACT

A tray for displaying a product for sale, where the tray includes a re-closeable lid. The tray includes a base having a peripheral side wall with a rim bounding an opening to a cavity which retains the product. A portion of the lid is permanently engaged with a section of the base. The rest of the lid is selectively engageable with the rest of the base and is movable between open and closed positions. When closed, a part of the lid is positioned laterally adjacent the rim and is located in a common plane therewith. The edges of the rim and lid frictionally engage each other to secure the base and lid together. The movable part of the lid, which includes a frame member and flexible film, rotate about a living hinge in the frame member. A latching mechanism is engaged to keep the lid and base engaged.

18 Claims, 10 Drawing Sheets

(56) References Cited

U.S. PATENT DOCUMENTS

| | | | | |
|---|---|---|---|---|
| 5,353,935 | A | 10/1994 | Yeager et al. | |
| D378,734 | S | 4/1997 | Hardy et al. | |
| D502,061 | S | 2/2005 | Dais et al. | |
| D553,010 | S | 10/2007 | Cutts et al. | |
| 7,401,703 | B2 | 7/2008 | McMichael et al. | |
| D591,173 | S | 4/2009 | Church | |
| D603,697 | S | 11/2009 | Edwards et al. | |
| D682,682 | S | 5/2013 | Biery | |
| D683,210 | S | 5/2013 | Cox et al. | |
| D695,113 | S | 12/2013 | Biery | |
| D720,471 | S | 12/2014 | Angel et al. | |
| D743,272 | S | 11/2015 | Rasgon | |
| D747,964 | S | 1/2016 | Limback | |
| 2003/0183540 | A1* | 10/2003 | Onishi | B65D 43/168 206/205 |
| 2008/0118609 | A1 | 5/2008 | Harlfinger | |
| 2014/0373330 | A1* | 12/2014 | Vanmechelen | B29C 51/306 29/428 |
| 2015/0021224 | A1 | 1/2015 | Vossoughi et al. | |
| 2015/0069064 | A1* | 3/2015 | Johnson | B65D 43/162 220/324 |

* cited by examiner

TRAY WITH RE-CLOSEABLE LID

CROSS-REFERENCE TO RELATED APPLICATIONS

This application is a divisional of U.S. patent application Ser. No. 14/836,171, filed Aug. 26, 2015, the entire disclosure of which is incorporated herein.

BACKGROUND OF THE INVENTION

Technical Field

This invention relates generally to devices used to display articles for sale and which may subsequently be used to temporarily store the articles as they are used over a period of time. More particularly, this invention is directed to a device utilized in the sale and subsequent temporary storage of food products such as cheese or cold cuts of meat. Specifically, the invention is a tray including a base and a re-closeable lid, where part of the lid is permanently attached to the base and another part of the lid is movable between an open and closed position about a living hinge and when in a closed position is retained in side-by-side engagement with the base by friction.

Background Information

Food products, such as cheese, may be sold in stores in a variety of different ways. In some instances, blocks of cheese may be vacuum packed or shrink-wrapped in plastic packaging that then closely approximates the contours of the cheese block or slices. In other instances slices of cheese or grated cheese is packaged in plastic bags under vacuum or modified atmosphere conditions. These bags may include a zipper structure which enables the bags to be reclosed after initial opening. The bags may also include a hang tag that permits the bag to be hung on a display in a refrigerated unit.

In other instances, blocks or slices of cheese or cold cuts of meat may be placed in thermoformed polypropylene trays that are sealed with a flexible film or with a rigid film. The food product is retained within a modified atmosphere within the interior of the tray. In some instances, the trays may include detached lids which enable a consumer to open the tray, remove the food product therefrom and then snap-fit the lid back onto the tray, locking the food product within the interior.

SUMMARY

There is still a need in the art for a simple and relatively inexpensive re-closeable container that may be used to both display a product for sale and store that product for use over a period of time.

A tray for displaying a product for sale, where the tray includes a re-closeable lid. The tray includes a base having a peripheral side wall with a rim bounding an opening to a cavity which retains the product. A portion of the lid is permanently engaged with a section of the base. The rest of the lid is selectively engageable with the rest of the base and is movable between open and closed positions. When closed, a part of the lid is positioned laterally adjacent the rim and is located in a common plane therewith. The edges of the rim and lid frictionally engage each other to secure the base and lid together. The movable part of the lid, which includes a frame member and flexible film, rotate about a living hinge in the frame member. A latching mechanism is engaged to keep the lid and base engaged.

In one aspect, the invention may provide a re-closeable tray comprising a base having a peripheral side wall with a rim, said base defining a cavity adapted to receive an article for sale therein, and wherein the rim defines an opening to the cavity; a lid, wherein a portion of the lid is permanently engaged with a section of the base and the rest of the lid is movable between an open position where the cavity is accessible and a closed position where the cavity is not accessible; and when the lid is in the closed position, a part of the lid is positioned laterally adjacent the rim.

In another aspect, the invention may provide a tray as described above wherein the part of the lid and the rim are located in a common plane or where the rim is located substantially at right angles to the peripheral side wall of the base and the part of the lid is similarly oriented when the lid is in the closed position.

In another aspect the invention may provide a tray as described above wherein an exterior edge of the rim is laterally adjacent an interior edge of the part of the lid when the lid is in the closed position or wherein an exterior edge of the rim and an interior edge of the part of the lid frictionally engage each other when the lid is in the closed position.

In another aspect, the invention may provide a method of selling and storing food for later usage comprising the steps of providing a tray comprising a base defining a cavity for receiving the food therein; and a lid, where a portion of the lid is fixedly secured to a section of the base and the rest of the lid is retained on the rest of the base by friction and a plurality of bridging members which extend along a line of weakness in the lid; displaying the tray in a store; purchasing the tray; lifting the rest of the lid away from the rest of the base to break the bridging members; rotating the lid to an open position about an axis which extends along at least one living hinge on the lid; removing part of the food from the cavity; rotating the lid to the closed position to where an interior edge of a frame member of the lid is positioned adjacent an exterior edge a rim of the base; and frictionally retaining the lid and base together.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims.

Similar numbers refer to similar parts throughout the drawings.

DETAILED DESCRIPTION

Figure 1:
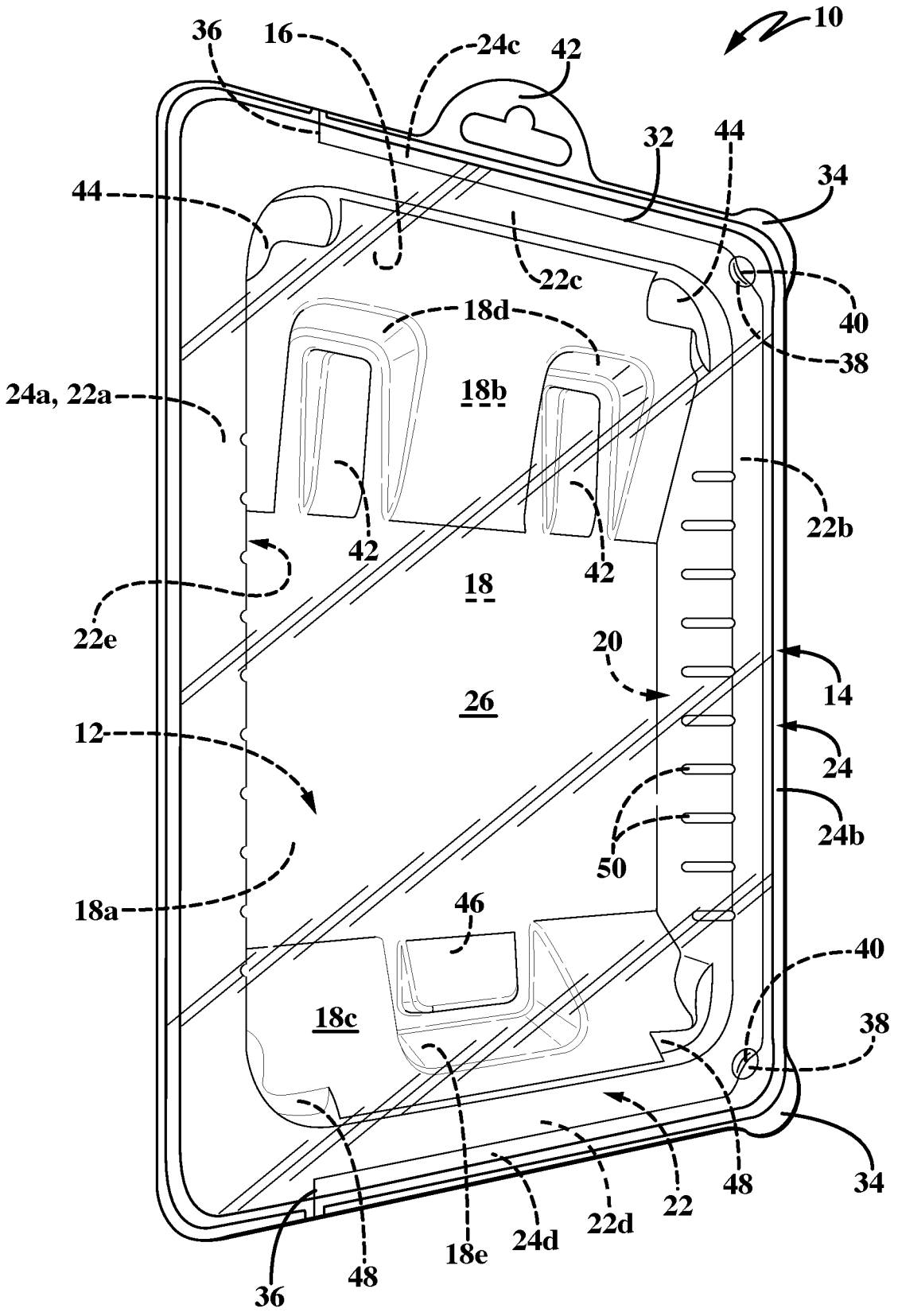
FIG. 1 is a perspective view of a food storage tray in accordance with an aspect of the present invention showing a lid of the tray in a closed position on a base of the tray.

Referring to FIGS. 1-12, there is shown a re-closeable tray in accordance with an aspect of the present invention, generally indicated herein by reference character 10. Tray 10 comprises a base 12 and a lid 14. Base 12 defines a cavity 16 therein (FIG. 2) which is shaped and sized to receive one or more articles or products for sale and use therein. One such article or product may be a food product such as a block or slices of cheese or cold cuts of meat. It will be understood however, that tray 10 may be used to display and store a wide range of products, such as fasteners, for example. The terms "product", "article", food product", or "cheese" used herein should be understood to be representative of any type of article or product that may be displayed and/or sold in tray 10 and then subsequently stored therein as the product is used over a period of time.

A section of lid 14 is fixedly and generally permanently secured to a portion of base 12, as will be further described herein. This secure attachment of lid 14 to base 12 ensures that the lid will not become misplaced once the tray 10 has been opened. There is also less likelihood of contamination because the user does not have to place the lid on a surrounding surface. The securement of lid 14 on base 12 also makes it easier to close tray after use as the lid 14 and base 12 will be properly aligned with each other.

The remaining part of lid 14 is detachably engaged with the rest of base 12. Lid 14 is selectively rotatable between a closed position (FIG. 1) where access to cavity 16 is prevented and an open position (FIG. 3) where access to cavity 16 is possible. Lid 14 is substantially retained on base 12 via a frictional interaction between the portion of lid 14 and section of base 12. A latching mechanism may be provided to retain lid 14 in the closed position to secure the food product therein. All of these component parts of tray 10 will be described in greater detail hereafter.

Figure 3:
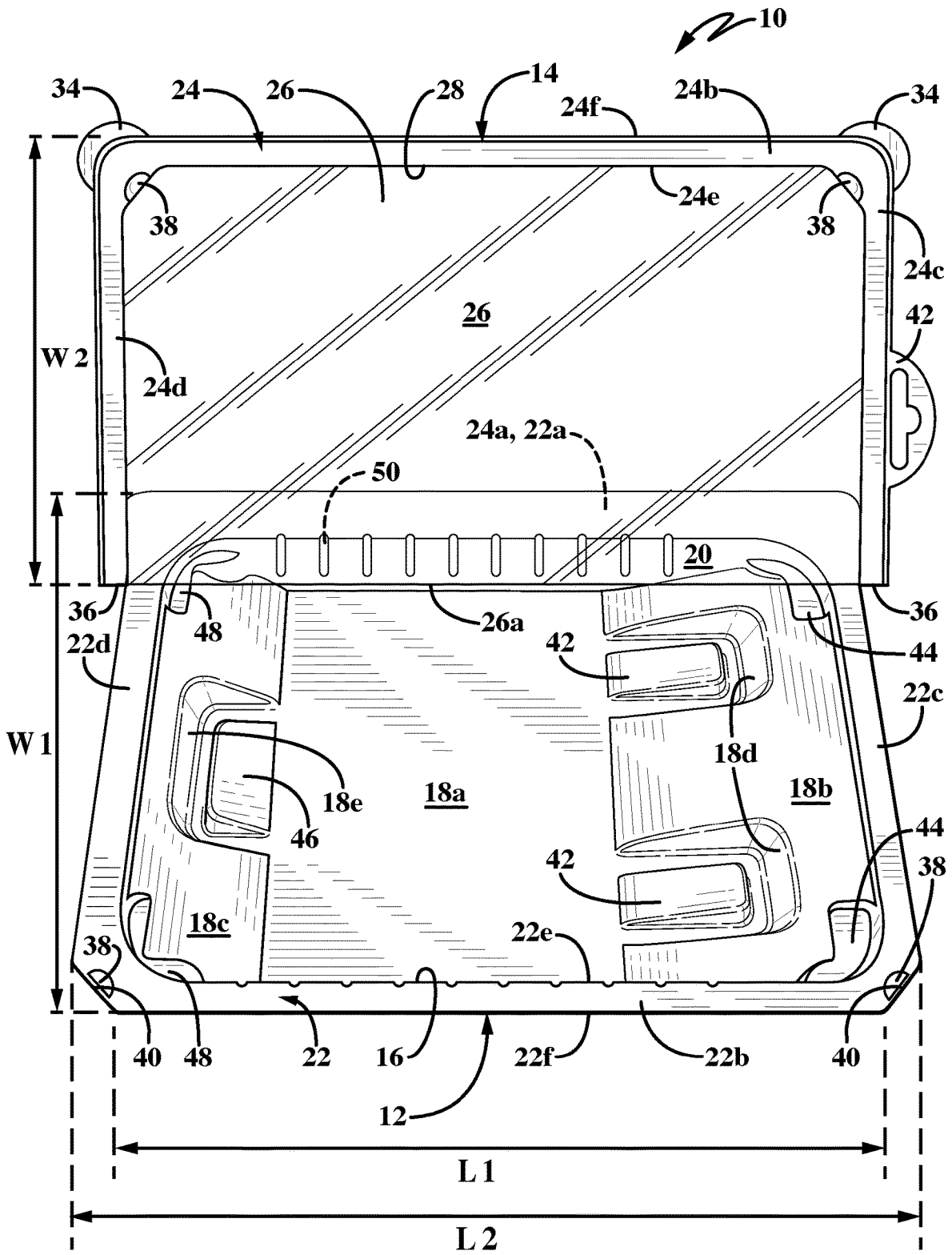
FIG. 3 is a top view of the tray with the lid moved to an open position and showing a cavity defined in the base.
Figure 4:
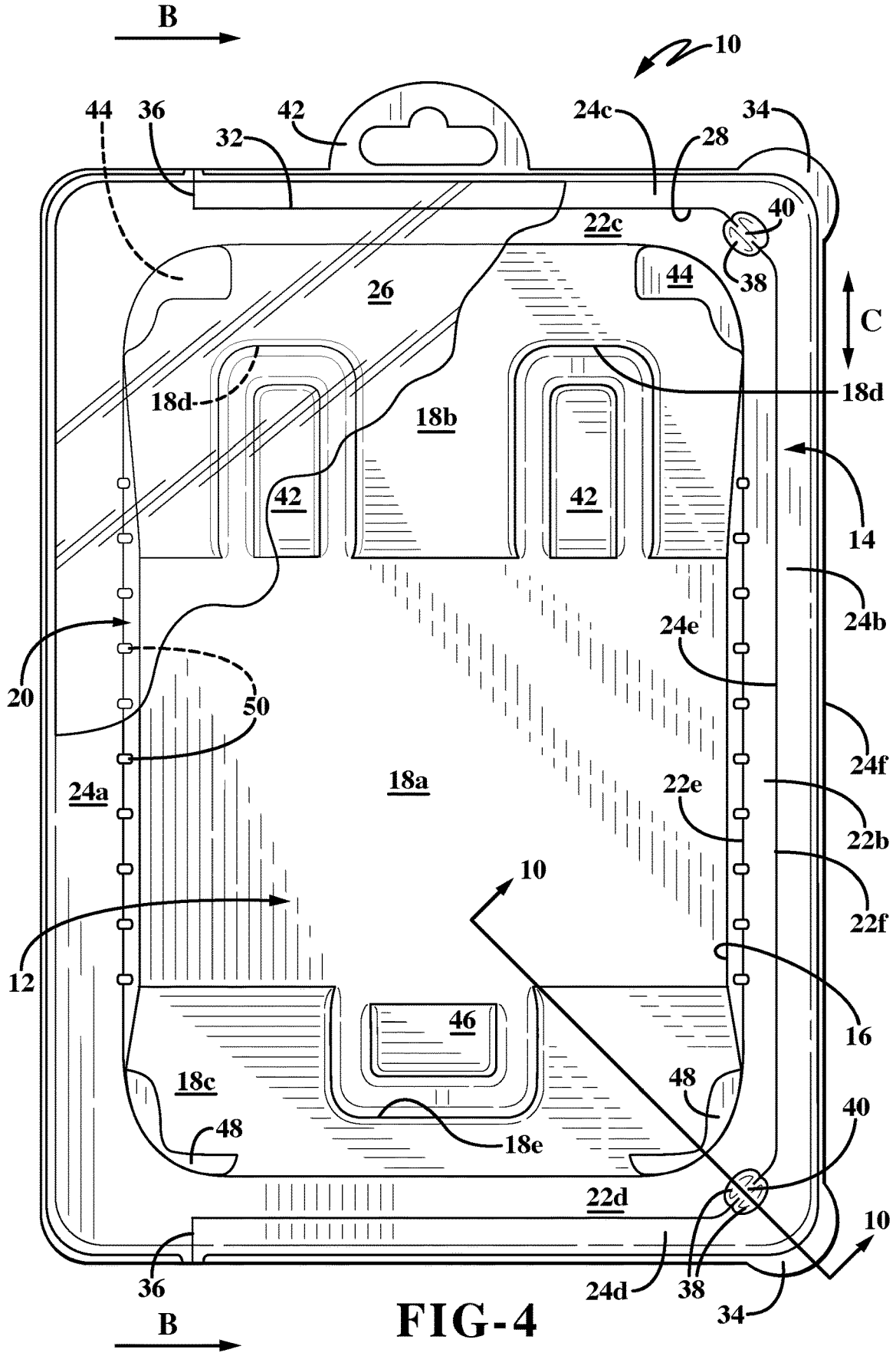
FIG. 4 is a top view of the tray in the closed position.
Figure 5:
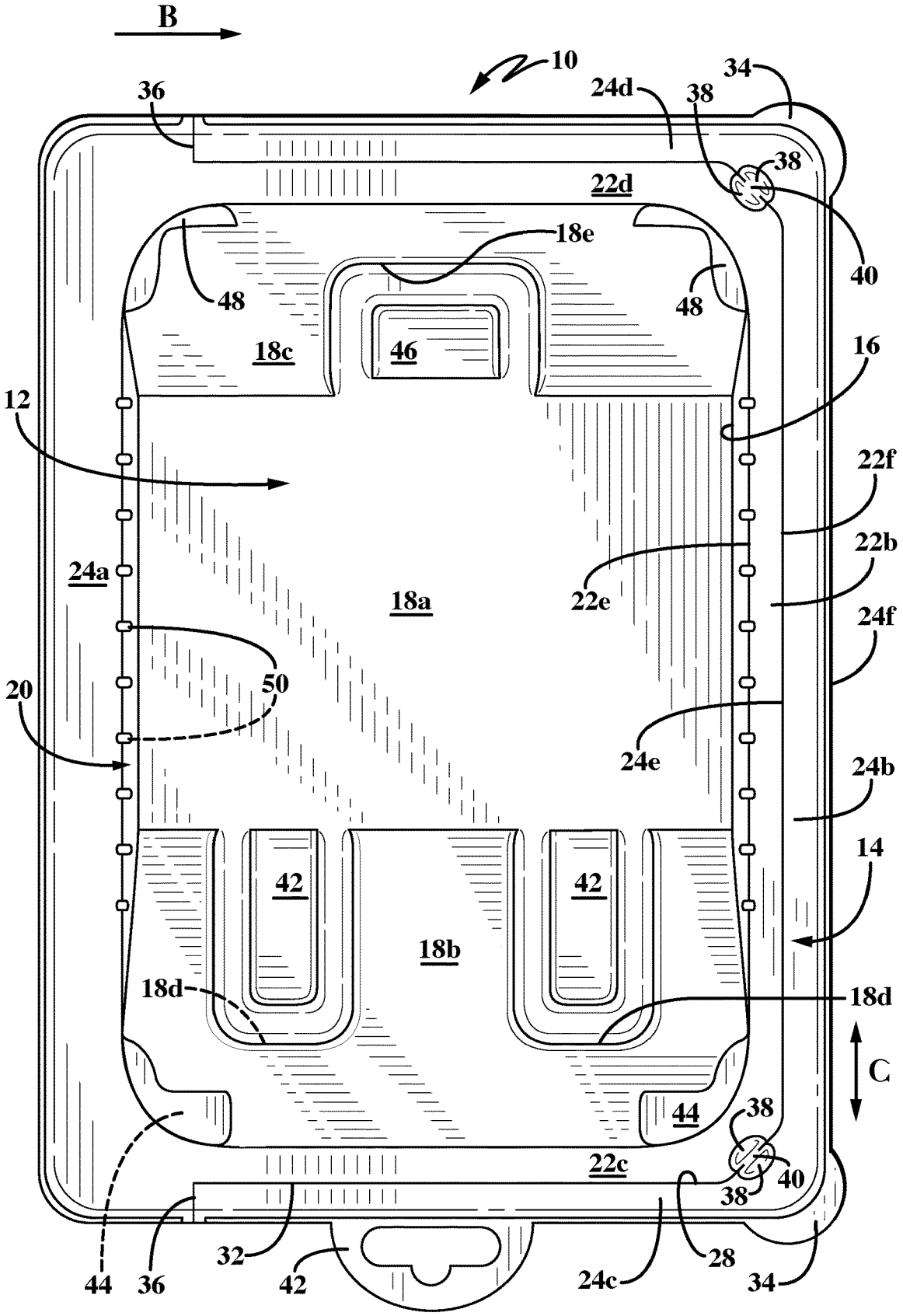
FIG. 5 is a bottom view thereof.

Base 12 may be fabricated in a suitable material, such as a plastic, for instance PET/EVOH/PE; and may be formed in any one of a variety of different shapes. One of these possible shapes is the generally rectangular shape illustrated in the attached figures. Base 12 includes a bottom wall 18 and a peripheral side wall 20 which extends upwardly and outwardly from bottom wall 18. Bottom wall 18 and peripheral side wall 20 together bound and define cavity 16. The peripheral side wall 20 terminates in a rim 22 which may be oriented generally at right angles to side wall 20. Because base 12, as shown, is generally rectangular when viewed from above (FIG. 3), rim 22 is also generally rectangular and includes a first section 22*a*, a second section 22*b*, a third section 22*c*, and a fourth section 22*d*. FIG. 3 shows that first section 22*a* may be wider than each of the other sections 22*b*, 22*c*, and 22*d*. Rim 22 has an interior edge 22*e* which bounds and defines an opening to cavity 16 and has an exterior edge 22*f* which forms the outermost peripheral edge of the base 12.

Lid 14 is shaped and sized to close off access to cavity 16 and since base 12 is generally rectangular when viewed from above, lid 14 may also be generally rectangular. As shown in FIG. 3, lid 14 may be comprised of a frame member 24 and a film member 26. Frame member 24 includes a first portion 24*a*, a second portion 24*b*, a third portion 24*c*, and a fourth portion 24*d* which form a rectangular shape. First, second, third and fourth portions 24*a*, 24*b*, 24*c*, 24*d* together have an interior edge 24*e* which bounds and defines an opening 28 which overlaps the opening defined by rim 22 when lid 14 is in the closed position. First, second, third and fourth portions 24*a*, 24*b*, 24*c*, and 24*d* also have an exterior edge 24*f* which defines the outermost perimeter of lid 14.

Film member 26 is secured in any suitable manner to frame member 24. For instance, film member 26 may be heat welded to frame member 24 or may be adhesively secured thereto. Film member 26 is secured to each of first, second, third and fourth portions 24*a*-24 *d* of frame member 24, and extends outwardly beyond interior edge 24*e* and toward exterior edge 24*f* thereof. Film member 26 may be fully or partially transparent so that the food received in cavity 16 of base 12 is fully or partially viewable therethrough. Obviously, film member 26 may, alternatively, be fully opaque and nothing retained within cavity 16 may be viewed from the outside. Film member 26 may be sufficiently flexible to allow lid to be moved easily between the open and closed positions. Film member 26 further is stiff enough and yet flexible enough to effectively seal the opening to cavity 16 defined by rim 22 when lid 14 is moved to the closed position.

In accordance with an aspect of the invention, first portion 24*a* of lid 14 is fixedly and permanently secured to first section 22*a* of base 12 in any suitable manner. For example, first portion 24*a* may be heat welded or adhesively secured to first section 22*a*. The securement is such that when the lid is moved to the open position, first portion 24*a* and first section 22*a* will not disengage each other. For all intents and purposes first portion 24*a* and first section 22*a* become a single component once suitably bonded. Alternatively, instead of first portion 24*a* being secured to first section 22*a*, first portion 24*a*, and first section 22*a* may be molded as an integral, single, or monolithic unit during fabrication of tray 10.

The remaining portions 24*b*, 24*c* and 24*d* of frame member 24 are not permanently secured to base 12 but may be selectively and temporarily engaged therewith when lid 14 is moved to a closed position, as will be discussed later herein. When lid 14 is moved to the closed position, interior edge 24*e* of frame member 24 may be disposed adjacent exterior edge 22*f* of rim 22 or at least proximate thereto. Additionally, frame member 24 and rim 22 may be generally aligned along a common plane. In other words, frame member 24, except for first portion 24*a* thereof, is positioned in the same plane as rim 22. As illustrated in the attached figures, frame member 24 is located a distance laterally outwardly beyond rim 22 as this provides for the best sealing of the opening to cavity 16. However, in other instances it may be desirable for tray 10 to be configured so that frame member 24 is located laterally inwardly of rim 22.

So, in accordance with an aspect of the present invention, frame member 24 may be bigger than rim 22 of base 12. Referring to FIG. 3, rim 22 is shown to have a length "L1" and a width "W1" while frame member 24 is shown to have a length "L2" and a width "W2". Length "L2" is greater than length "L1". Similarly, width "W2" is greater than width "W1".

As discussed above, during fabrication of tray 10, lid 14, and rim 22 are molded and bonded together along first section 22*a* and first portion 24*a*. Additionally, a plurality of small bridging elements 30 extend between interior edge 24*e* of frame member 24 and exterior edge 22*f* of rim 22. The bridging elements retain rim 22 and frame member 24 in a common plane and in edge-to-edge orientation relative to each other. There is a small gap defined between interior edge 24*e* of frame member 24 and exterior edge 22*f* of rim 22. Interior edge 24*e*, exterior edge 22*f*, and bridging elements 30 together form a line of weakness in tray 10. This line of weakness, identified by the number 32 in FIG. 1, is generally U-shaped when viewed from the top and originates proximate a first end of the bonded first section 22*a* and first portion 24*a* and terminates proximate a second end thereof.

Figure 14:
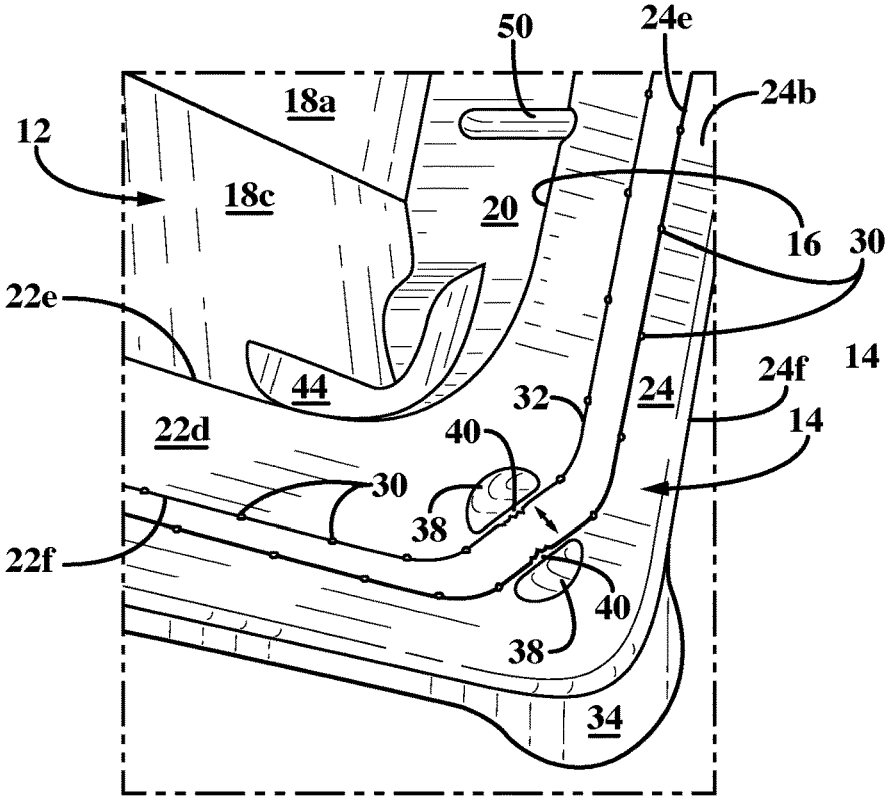
FIG. 14 is an enlarged view of the highlighted region of FIG. 12.

In accordance with another aspect, the invention may provide one or more lift tabs 34 which extend outwardly beyond the exterior edge 24*f* of frame member 24. Lift tabs 34 may be provided adjacent the corners of frame member 24 where second and third portions 24*b*, 24*c* and second and fourth portions 24*b*, 24*d* meet. Lift tabs 34 may additionally or alternatively be provided anywhere else on frame member 24. Each lift tab 34 may be curved so as to reduce the likelihood of hurting a user who attempts to grasp the same to open lid 14. Lift tabs 34 provide the user with an enlarged gripping surface to grasp when they move lid 14 from the closed position to the open position or vice versa. The possible movement of lid 14 is indicated by arrow "A" in FIGS. 11, 12 and 14.

During opening of tray 10 for the first time, lid 14 is lifted upwardly and outwardly in the direction of arrow "A". This motion moves frame member 24 out of alignment with rim 22 and causes bridging elements 30 to break, thus permitting frame member 24 to move independent of rim 22. The lifting motion causes frame member 24 to bend back over the bonded first portion 24*a* and first section 22*a*. The bending occurs along an axis which passes through two regions of frame which are identified in FIGS. 11 and 12 by the reference character 36. These regions are part of frame member 24 and because the bending motion occurs along these regions, these regions act as living hinges 36. Because film 26 is secured to frame member 24, as frame member 24 pivots about an axis running along living hinges 36, that portion 26*a* of film 26 which extends between the two living hinges 36 will tend to fold and lid 14 is therefore openable to the position shown in FIG. 3. When lid 14 is in this open position, the product within the cavity 16 is accessible to the user.

Lid 14 may be closed by reversing the steps identified above, In this instance, frame member 24 of lid 14 is rotated about the axis extending along living hinges 36 until second, third and fourth portions 24*b*, 24*c*, 24*d* thereof are once again generally aligned along a common plane with rim 22. Second, third and fourth portions 24*b*-24*d* are located laterally outwardly of rim 22 and in such a way that exterior edge 22*f* of rim 22 is located adjacent and generally parallel to interior edge 24*e* of frame member 24.

Tray 10 may be provided with a latching mechanism to aid in retaining lid 14 in this closed position. One suitable type of latching mechanism is illustrated herein and comprises one or more depressions formed in one or the other or both of lid 14 and rim 22 and one or more complementary bosses provided in the other of the lid 14 and rim 22. As illustrated herein, depressions 38 are defined in an uppermost surface of rim 22 proximate exterior edge 22*e* thereof and adjacent the corners of tray 10 opposed to bonded first portion 24*a* and first section 22*a*. Complementary positioned, shaped, and sized bosses 40 are provided on the inside surface of frame member 24. Apart from the secured first portion 24*a* and first section 22*a*, the only region that frame member 24 overlaps any part of rim 22 is a small area proximate each of the two corners of tray 10 where the bosses and depressions are located. As illustrated in the attached figures, particularly FIG. 3, the depression 38, and boss 40 are discrete area located in the proximity of the corners of frame member 24 and lift tabs 34. When lid 14 is moved to the closed position, the user will run their hand along the uppermost surface of frame member 24. This will cause frame member 24 to align with rim 22 and will cause bosses 40 to enter depressions 38. Bosses 40 will snap-fit into depressions 38. Thus, lid 14 is retained in a latched position relative to rim 22 by friction between interior and exterior edges 24*e*, 22*f* and depressions and bosses 38, 40. Even remnants of the bridging elements 30, which had to be broken during initial opening of lid 14, add in frictionally latching frame member 24 and rim 22 together. Thus, moving lid 14 to the closed position and smoothing the same to cause latching engagement between frame 24 and rim 22 closes and at least somewhat seals tray 14 because film member 26 is brought into sealing contact with the uppermost surface of rim 22. The slight downwardly pressure provided on frame member 24 also creates a type of minor vacuum seal of film member 26 to rim 22.

In accordance with another aspect, the invention may provide a hang tag 42 on one or both of lid 14 and base 12. As illustrated herein, hang tag 42 is provided only on lid 14. Hang tag 42 permits tray 10 to be suspended in a product display in a store. Lid 14 will not pop open when tray 10 is suspended via hang tag 42 because the bridging elements 30 remain intact until a consumer purchases tray 10 and its product contents and opens the same. Once the bridging elements 30 are broken, using the hang tag 42 may cause the tray 10 to accidentally pop open.

In accordance with another aspect, the invention may provide a base 12 having a sloped and shaped bottom wall and side walls. These sloped and shaped walls may serve multiple purposes including providing surfaces within the interior of tray 10 which will better display a product to be sold therein. Additionally or alternatively, the sloped and shaped walls may provide for improved air circulation around a product retained within tray or may provide areas for liquids from the product to drain into and thereby keep the product out of the same. A variety of different shapes and configurations of base 12 may be utilized in conjunction with the re-closeable and re-sealable lid 14.

Figure 2:
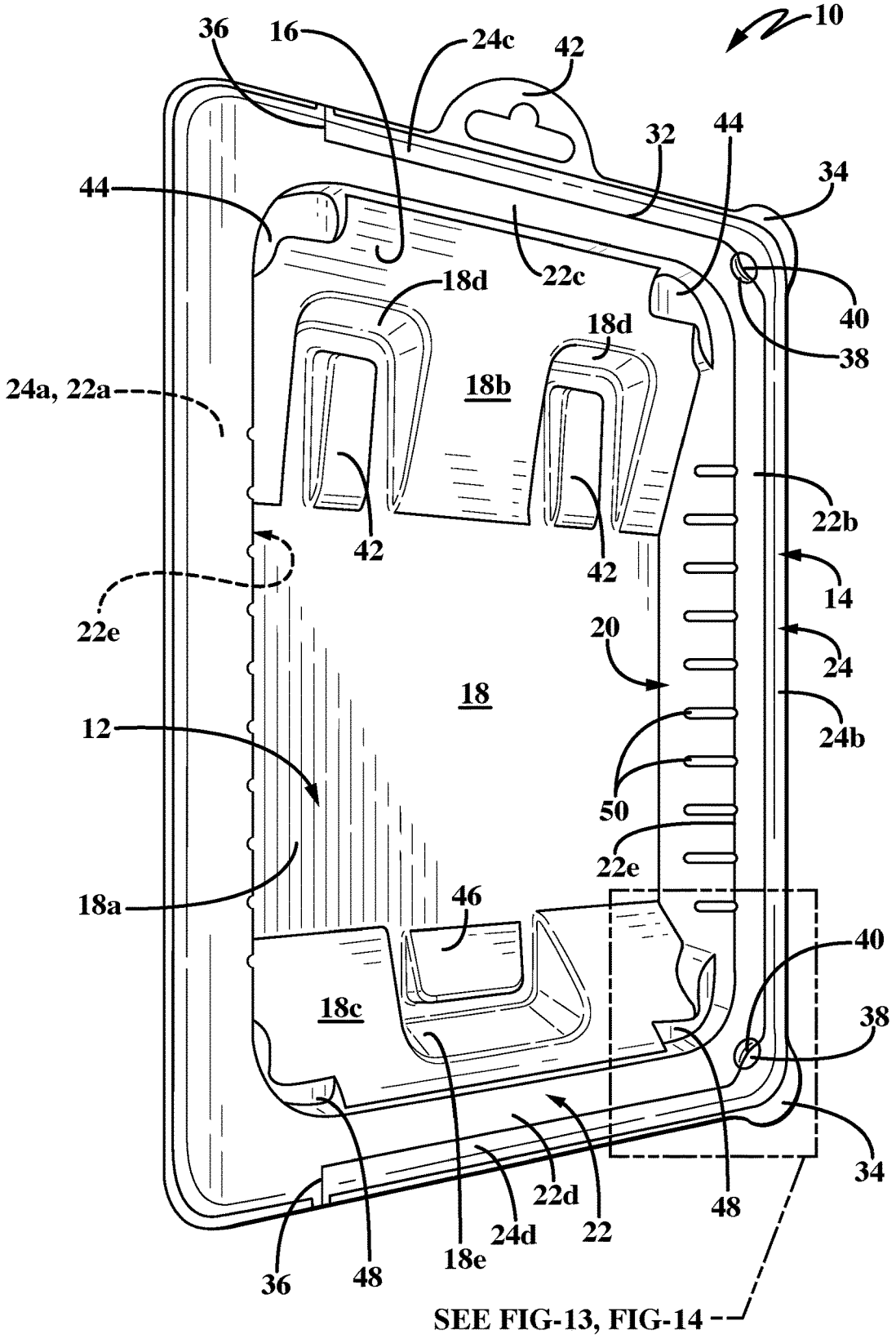
FIG. 2 is a top perspective view of the tray of FIG. 1 with a transparent film of the lid removed therefrom.
Figure 6:
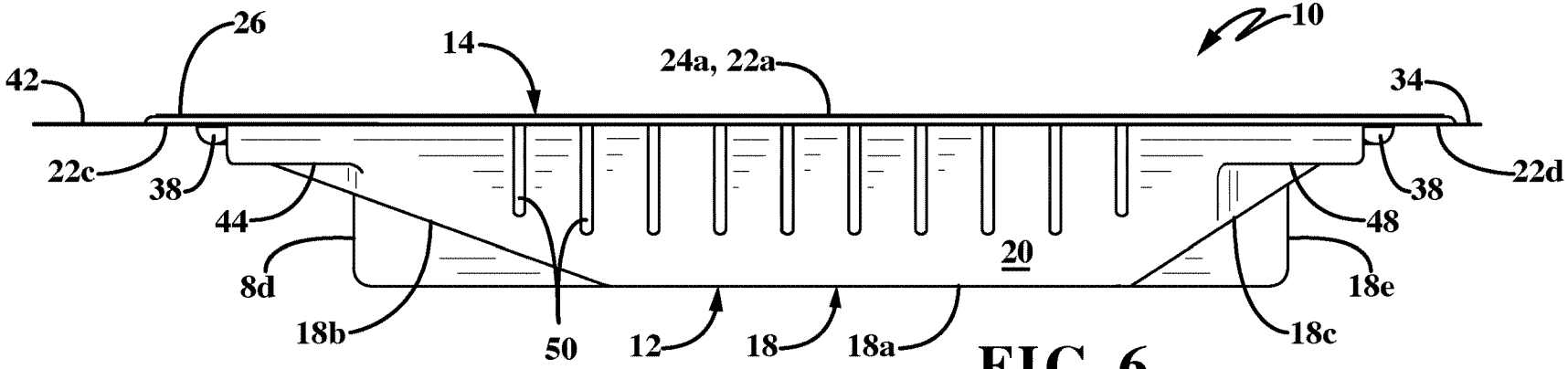
FIG. 6 is a left side view thereof.
Figure 7:
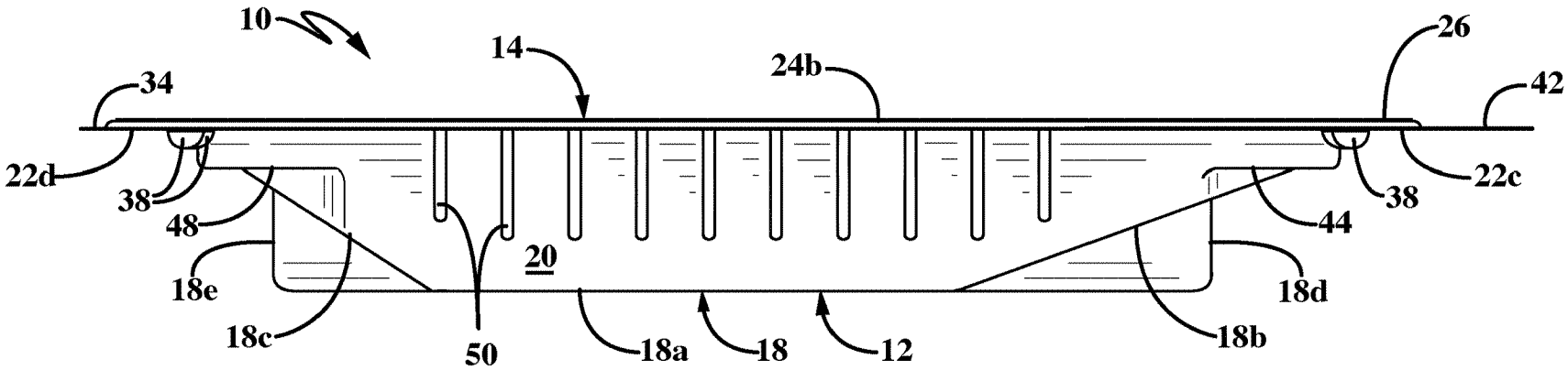
FIG. 7 is a right side view thereof.
Figure 8:
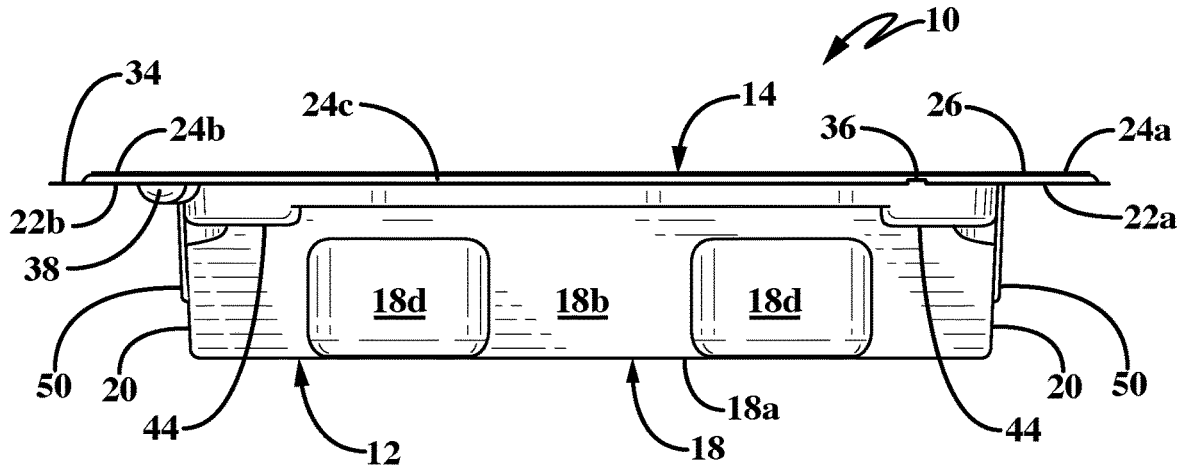
FIG. 8 is a first end view thereof.

The attached figures illustrate one possible configuration for the molded base 12. Referring to FIGS. 2 and 3, base 12 includes a bottom wall 18 (FIG. 2) and side walls 20. Bottom wall 18 includes a first section 18*a*, second section 18*b*, and a third section 18*c*. First section 18*a* is generally planar and second and third sections 18*b*, 18*c* angle outwardly away from opposite ends of first section 18*a* and generally in the same direction. FIGS. 6 and 7 show that second section 18*b* may be longer and of a shallower angle than third section 18*c*. First section 18*a* may be molded to include a pair of laterally spaced apart projections 18*d*. Projections 18*d* appear as depressions on the interior surface of second section 18*b* (as shown in FIG. 2) and as projections on the exterior surface thereof (as shown on FIG. 6). Each projection 18*d* may be generally rectangular in shape when viewed from above as in FIG. 3. The projections 18*d* may be generally triangular when viewed from the side (FIGS. 6 & 7). FIG. 2 shows that a generally triangular detent 42 may be molded into the interior of each projection 18*d*. Detent 42 extends inwardly into the depression on the interior surface of second section 18*d* and may appear as a recess on the exterior surface of second section 18*d* (as illustrated in FIG. 3). Detent 42 tapers in height from a back wall of projection 18*d* to the front opening thereof. A generally semi-circular shelf 44 may be molded into each of the corners of second section 18*b*. Shelves 44 appear as recesses within the interior of tray 14 but as projections on the exterior thereof. This may be seen in FIGS. 6 and 7. Second section 18*b* of bottom wall 18 may form all or part of the upper end wall of tray 10.

Third section 18*c* is molded to include a single projection 18*e* which takes the form of a depression on the interior surface of base 12 and a projection on the exterior surface of base 12. Projection 18*e* is generally rectangular when viewed from above and is generally centered longitudinally between projections 18*d*. Projection 18*e* is generally triangular when viewed from the side (FIGS. 6 and 7). A generally triangular detent 46 is molded into a central region of projection 18*e* and this detent 46 tapes in height from a back wall of projection 18*e* toward a front opening therein. Detent 46 may appear as a projection on the interior surface of base 12 and as a recess on the exterior surface thereof. Generally semi-circular shelves 48 may be molded into the corners of third section 18*c* and may appear as recesses within the interior of tray 10 and projections on the exterior surface thereof as shown in FIGS. 6 and 7.

Base 12 also includes side walls 20 which are connected along their lower edges to second section 18*b*, first section 18*a*, and third section 18*c* of bottom wall 18. Each of the first and second side walls 20 may include strengthening ribs 50 molded into the same. Each rib 50 may project outwardly from the exterior surface of base 12 and may comprise a groove defined in the interior surface thereof. Ribs 50 may be substantially parallel to each other and oriented generally at right angles to first section 18*a* of bottom wall 18. Rim 22 is provided at the uppermost ends of each side walls 20, second section 18*b*, and third section 18*c* of bottom wall 18. The rim 22 may be oriented generally parallel to first section 18*a* of bottom wall 18.

Tray 10 is used in the following manner. An article for sale is placed within cavity 16 of tray 10, and if necessary or desirable, a thin protective film (not shown) is bonded to a portion of rim 22 to seal the article for sale within cavity 16. The atmosphere between the thin protective film and bottom and side walls 18, 20 of tray 10 may be modified to increase the shelf life of the product retained in cavity 16 if that product is, for instance, a food product such as cheese or meat. The particular atmospheric modification will be selected based on the food product, as is well known in the art.

Lid 14 is applied to base 12, first portion 24*a* of lid 14 is bonded to first section 22*a* of rim 22, and bosses 40 are frictionally engaged in depressions 38. (At this point bridging members 30 remain intact). Thus, film member 26 may be positioned outwardly of any thin protective film used to seal the article for sale within tray 10. Tray 10 and its contents are ready for shipping and display. When tray 10 reaches the store in which it is to be sold, several trays 10 may be stacked one on top of the other with the base 12 of an upper tray 10 being placed on the lid 14 of the tray 10 immediately below it. Alternatively, hang tag 42 may be utilized to suspend tray 10 on a store display.

Figure 9:
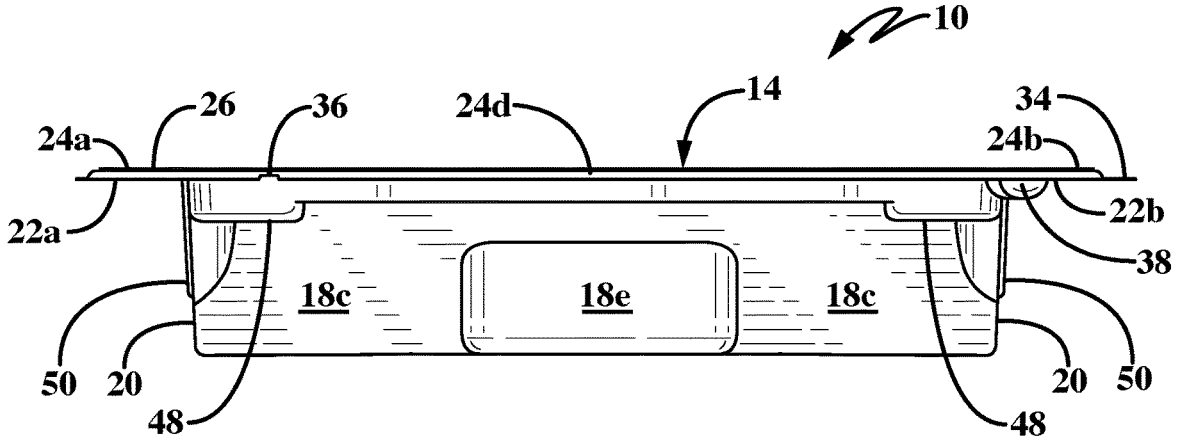
FIG. 9 is a second end view thereof.
Figure 10:
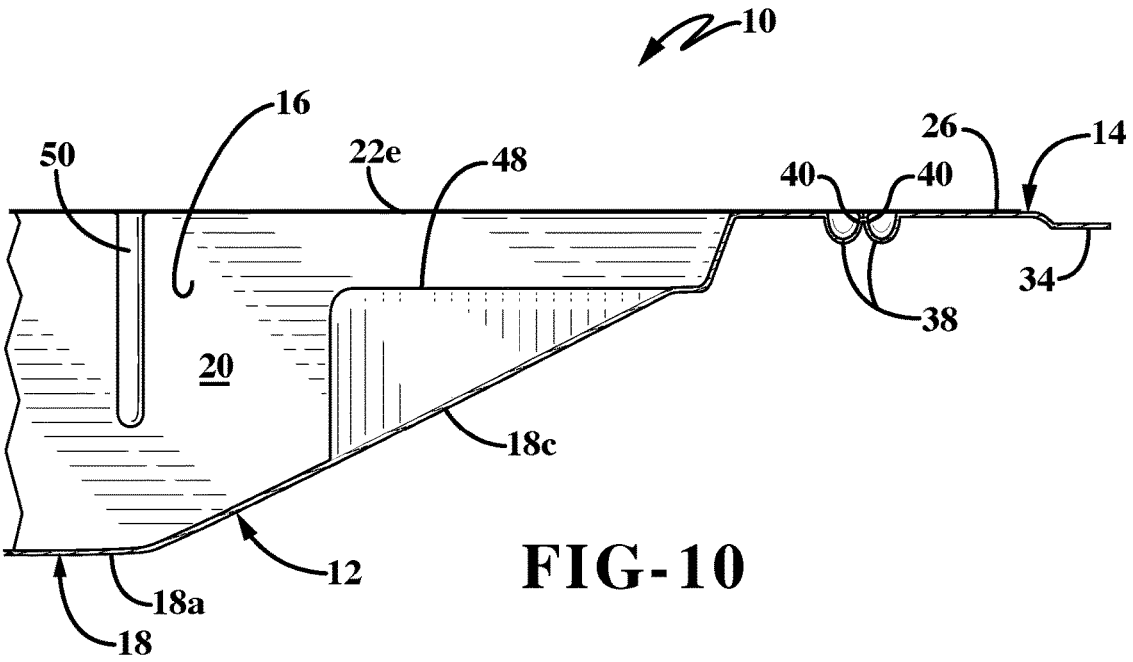
FIG. 10 is a cross-section taken along line 10-10 of FIG. 4.
Figure 11:
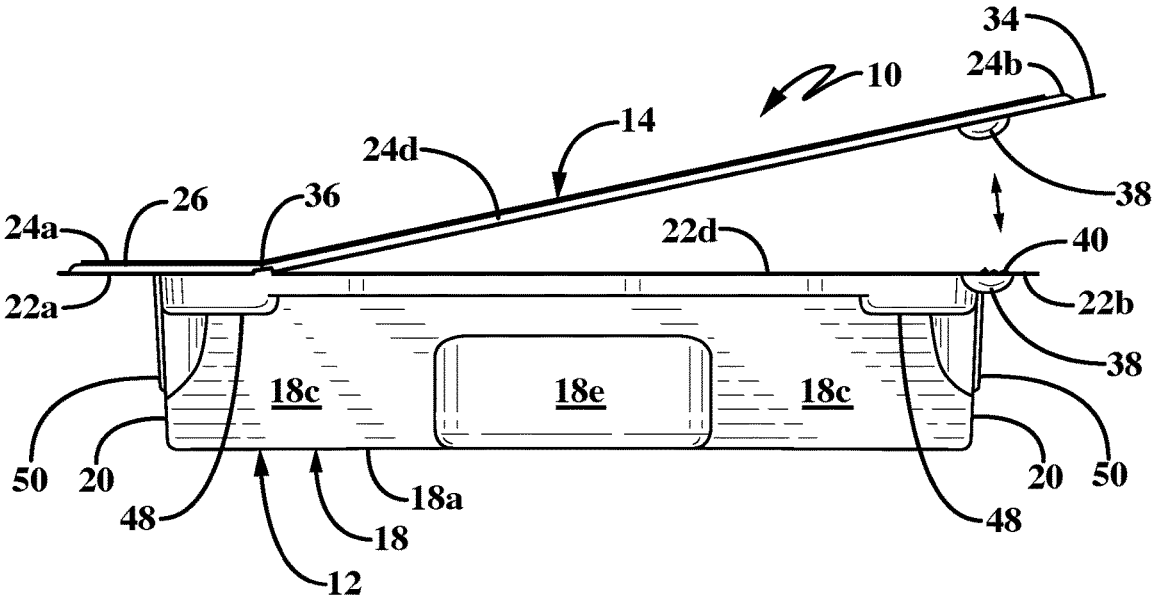
FIG. 11 is a second end view of the tray with the lid thereof in a partially opened position.
Figure 12:
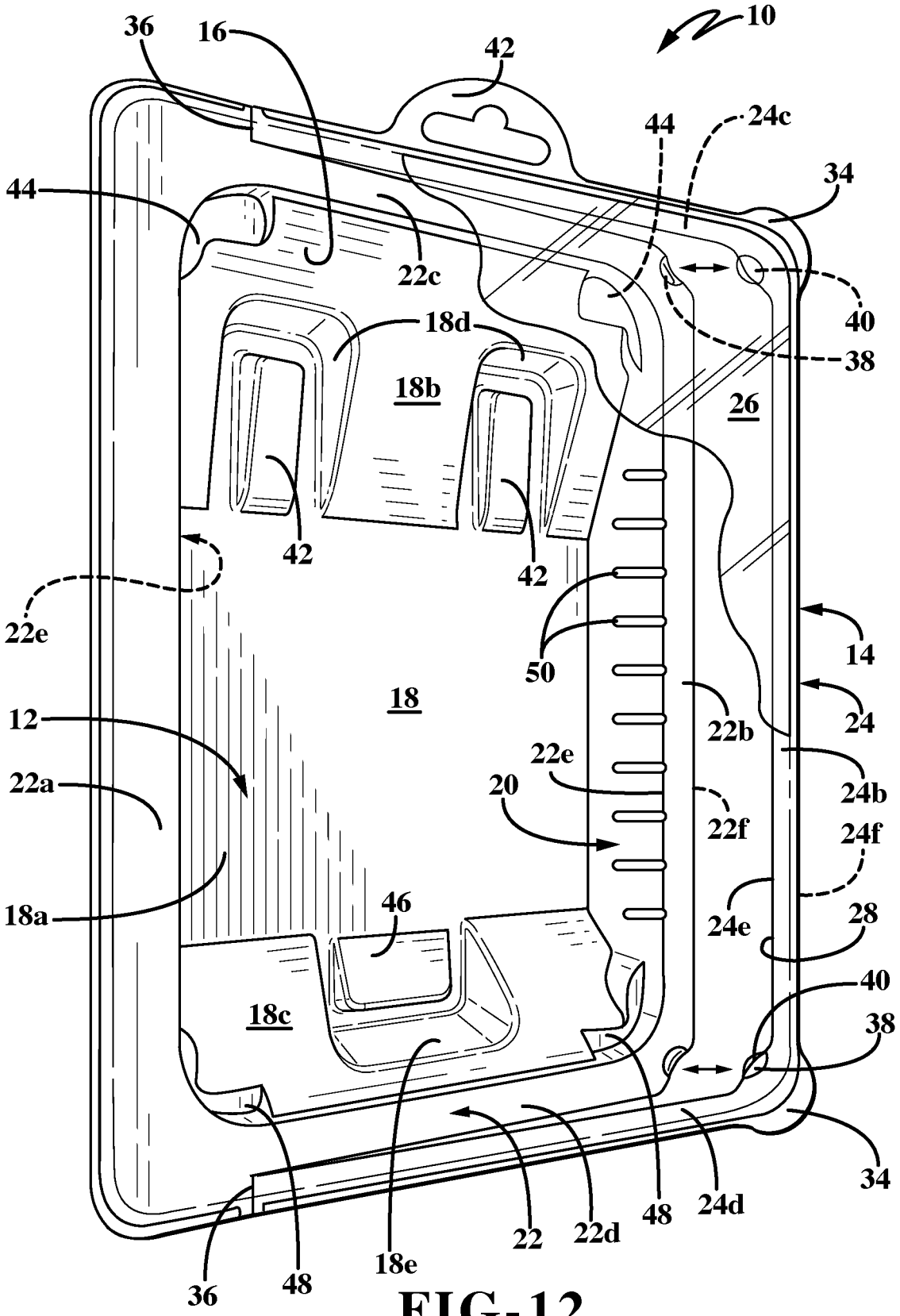
FIG. 12 is a top perspective view of the tray as shown in FIG. 11.
Figure 13:
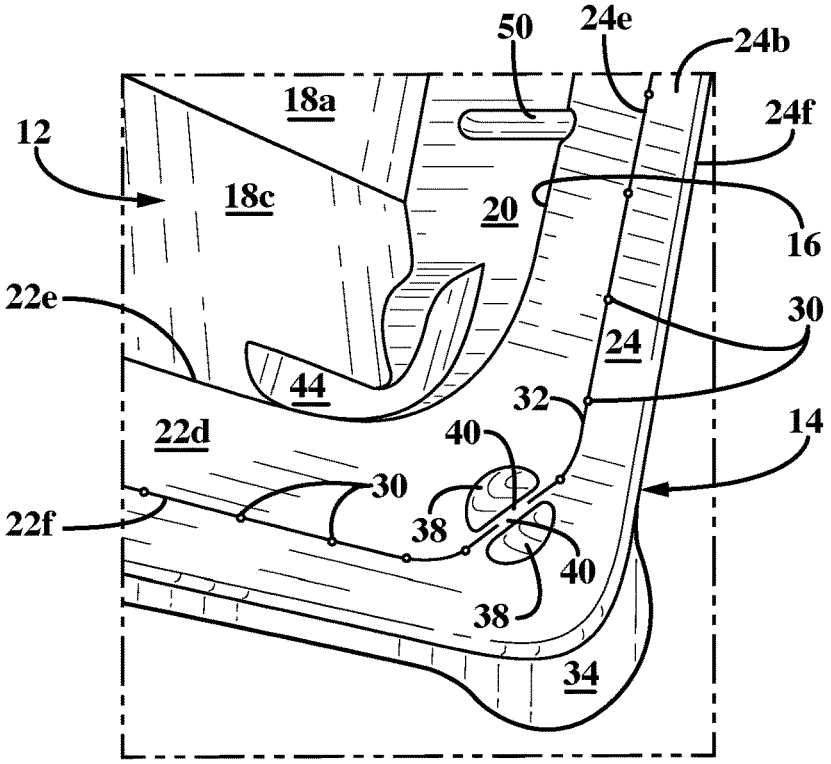
FIG. 13 is an enlarged view of the highlighted region of FIG. 1.

Once a consumer has purchased the tray 10 and its contents, they are able to open up tray 10 to access the contents thereof. The user will grasp one of lift tabs 34 and will pull lid upwardly (FIG. 9). Because of the frangible nature of frame member 24 (by virtue of the line of weakness 32 and small bridging members 30), frame member 24 will pull away from rim 22 on base 12 breaking bridging members 30 as it is pulled upwardly. Since frame member 24 is permanently sealed to only the first section 22*a* of base 12, the rest of frame member 24 (portions 24*b*, 24*c*, and 24*d*) will move away from rim 22 and rotate about living hinges 36 to the position shown in FIG. 3. If a thin protective film has been secured to rim 22, then that film may now be pulled free and discarded. The user is now free to gain access to the article retained within cavity 16 of base 12.

If it is desired to close tray 10 so that some of the article retained within cavity 16 may be utilized at a later time, the user will rotate lid 14 back to the closed position. Once frame member 24 is generally seated adjacent rim 22, the user will smooth down lid 14 by running their hands along each of the second, third, and fourth portions 24*b*, 24*c*, and 24*d* of frame member 24, as described earlier herein. This smoothing action may occur in the direction indicated by arrows "B" and "C" in FIG. 4. This smoothing motion will cause frame member 24 to move back into a common plane with rim 22 and will cause bosses 40 to enter and become engaged in depressions 38. Film member 26 not only allows the contents of tray 10 to be seen from the outside but also acts as a protective barrier against contamination of the contents thereof from outside sources. Additionally, the smoothing motion of film member 26 along rim 22 creates a slight suction which helps retain lid 14 on base 12, thereby effectively sealing tray 10. After opening, tray will typically be stored so that the bottom wall 18*a* of base 12 will rest on a flat surface.

Other modifications to tray 10 may be possible. For instance, frame member 24 may be provided with strengthening ribs which run either parallel to the length of one of the portions 24*b*-24*d* or at right angles thereto. Additionally, instead of discrete depressions 38 and bosses 40, the opposing surfaces of rim 22 and frame member 24 may be provided with an interlocking groove and ridge to help latch lid 14 to base 12.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration set out herein are an example and the invention is not limited to the exact details shown or described.

The invention claimed is:

1. A re-closeable tray comprising:

a base having a peripheral side wall with a rim, said base defining a cavity adapted to receive an article therein, and wherein the rim defines an opening to the cavity;

a lid, wherein a portion of the lid is permanently engaged with a section of the base and a rest of the lid is movable between an open position where the cavity is accessible and a closed position where the cavity is not accessible;

wherein when the lid is in the closed position, a part of the lid is positioned laterally adjacent the rim;

wherein the lid includes a frame member and a film member; and the portion of the lid permanently engaged with the section of the base is a portion of the frame member; and a rest of the frame member which temporarily engages a rest of the base is a U-shaped member which extends outwardly from the engaged portion of the frame member;

wherein the U-shaped member of the frame member bounds and defines a frame opening and the film member extends across the entire frame opening; and wherein the base has a bottom wall that comprises at least a first section and a second section, wherein the first section is planar and oriented generally parallel to the rim of the base; and the second section angles downwardly from the rim toward one end of the first section.

2. The tray as defined in claim 1, wherein the part of the lid and the rim are located in a common plane.

3. The tray as defined in claim 1, wherein the rim is located substantially at right angles to the peripheral side wall of the base and the part of the lid is similarly oriented when the lid is in the closed position.

4. The tray as defined in claim 1, wherein an exterior edge of the rim is laterally adjacent an interior edge of the part of the lid when the lid is in the closed position.

5. The tray as defined in claim 1, wherein an exterior edge of the rim and an interior edge of the part of the lid frictionally engage each other when the lid is in the closed position.

6. The tray as defined in claim 1, wherein at least one of the base and lid includes a hang tag.

7. The tray as defined in claim 1, further comprising a latching mechanism that temporarily secures the movable rest of the lid to the base when the lid is in the closed position.

8. The tray as defined in claim 7, wherein the latching mechanism comprises a depression defined on one of the lid and the base and a complementary boss is defined in the other of the lid and the base; and wherein the boss is frictionally received within the depression when the lid is in the closed position.

9. The tray as defined in claim 1, further comprising at least one lift tab provided on the lid, where the lift tab extends for a distance outwardly beyond an exterior edge of the lid.

10. The tray as defined in claim 1, wherein the lid includes a living hinge about which the lid rotates between the open position and the closed position; and wherein the living hinge is located on the lid a distance outwardly away from an exterior edge of the base's rim.

11. The tray as defined in claim 1, further comprising at least one depression provided within the second section of the bottom wall.

12. The tray as defined in claim 1, wherein the bottom wall further comprises a third section that angles downwardly from the rim toward an end of the first section that is opposed to the end of the first section adjacent the second section; and wherein the first section and the third section are oriented at an obtuse angle relative to each other.

13. The tray as defined in claim 12, wherein the obtuse angle between the first section and the second section is different from the obtuse angle between the first section and the third section.

14. The tray as defined in claim 12, further comprising at least one recess provided in the third section.

15. The tray as defined in claim 1, further comprising a plurality of ribs provided on an interior surface of the peripheral side wall.

16. The tray as defined in claim 1, wherein the film member is one of partially transparent and entirely transparent.

17. The tray as defined in claim 1, wherein the U-shaped member is integral with the portion of the frame member that is permanently engaged with the base's rim.

18. The tray as defined in claim 17, wherein a living hinge is formed in frame member adjacent the portion of the frame member, and the living hinge permits the U-shaped member of the frame member to be rotated between the open position and the closed position.

* * * * *